US009997153B2

(12) United States Patent
Yamamoto et al.

(10) Patent No.: US 9,997,153 B2
(45) Date of Patent: Jun. 12, 2018

(54) INFORMATION PROCESSING METHOD AND INFORMATION PROCESSING DEVICE

(71) Applicant: Yamaha Corporation, Hamamatsu-shi, Shizuoka-Ken (JP)

(72) Inventors: Naoki Yamamoto, Hamamatsu (JP); Yuki Murakami, Shimada (JP)

(73) Assignee: Yamaha Corporation, Hamamatsu-shi (JP)

( * ) Notice: Subject to any disclaimer, the term of this patent is extended or adjusted under 35 U.S.C. 154(b) by 101 days.

(21) Appl. No.: 15/241,186

(22) Filed: Aug. 19, 2016

(65) Prior Publication Data

US 2017/0053642 A1 Feb. 23, 2017

(30) Foreign Application Priority Data

Aug. 21, 2015 (JP) ..... 2015-163763

(51) Int. Cl.

| | |
|---|---|
| ***G10L 13/00*** | (2006.01) |
| ***G10L 13/033*** | (2013.01) |
| ***G10L 13/10*** | (2013.01) |
| ***G10H 1/00*** | (2006.01) |
| ***G10H 1/36*** | (2006.01) |
| *G10L 13/08* | (2013.01) |
| *G10L 21/10* | (2013.01) |

(52) U.S. Cl.

CPC ..... *G10L 13/033* (2013.01); *G10H 1/00* (2013.01); *G10H 1/368* (2013.01); *G10L 13/10* (2013.01); *G10H 2220/101* (2013.01); *G10H 2250/455* (2013.01); *G10L 2021/105* (2013.01)

(58) Field of Classification Search

CPC ..... G10L 13/033; G10L 21/055; G10L 13/10
USPC ..... 704/220, 235, 258, 260
See application file for complete search history.

(56) References Cited

U.S. PATENT DOCUMENTS

2006/0026207 A1* 2/2006 Sakai ..... H04L 12/1813

FOREIGN PATENT DOCUMENTS

| | | |
|---|---|---|
| JP | 2008-165130 A | 7/2008 |
| JP | 2008-170592 A | 7/2008 |

OTHER PUBLICATIONS

"VOCALOID2 Owner's Manual", Yamaha Corporation, Aug. 2007, with English translation (nine (9) pages).

* cited by examiner

*Primary Examiner* — Thierry L Pham
(74) *Attorney, Agent, or Firm* — Crowell & Moring LLP

(57) ABSTRACT

An information processing method includes receiving a change instruction to change a voice parameter used in synthesizing a voice for a set of texts, changing the voice parameter in accordance with the change instruction to change the voice parameter, changing, in accordance with the change instruction, an image parameter used in synthesizing an image of a virtual object, the virtual object indicating a character that vocalizes the voice that has been synthesized, synthesizing the voice using the changed voice parameter, and synthesizing the image using the changed image parameter.

6 Claims, 8 Drawing Sheets

FIG. 6
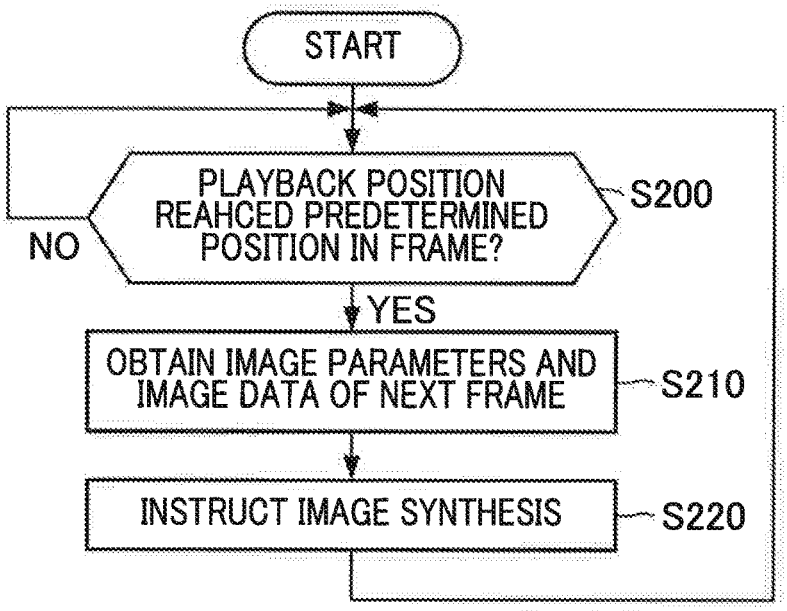
FIG. 7
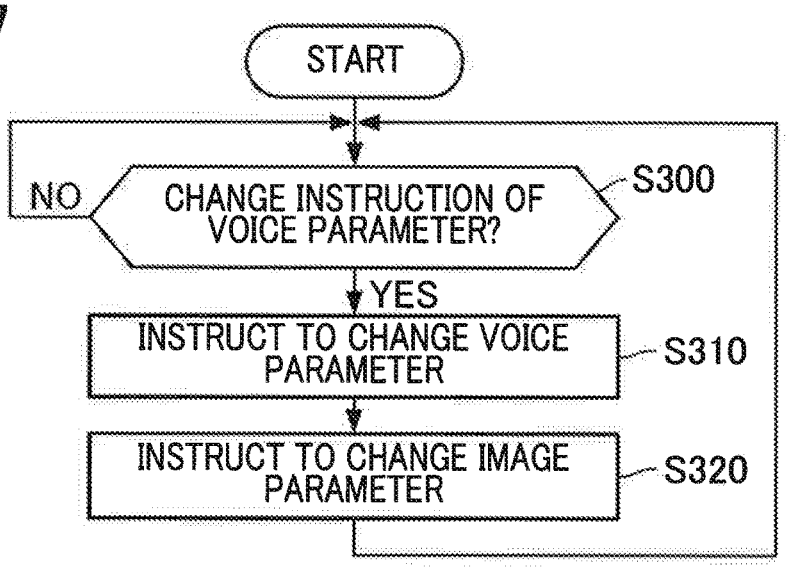
FIG. 8
| VOICE PARAMETER | IMAGE PARAMETER | COEFFICIENT |
|---|---|---|
| DYN | SIZE | 1 |
| GEN | PROPORTION | 0.5 |

INFORMATION PROCESSING METHOD AND INFORMATION PROCESSING DEVICE

BACKGROUND OF THE INVENTION

1. Field of the Invention

The present invention relates to voice synthesis and image synthesis technologies.

2. Description of the Related Art

A technology for synthesizing a singing voice by use of a computer device is commonly known in the art. For example, Japanese Patent Application Laid-Open Publication No. 2008465130 (hereinafter, JP 2008-165130) discloses a technique for editing data that represents parameters used in voice synthesis. As other examples, Japanese Patent Application Laid-Open Publication No. 2008-170592 (hereinafter, JP 2008-170592) and YAMAHA Corporation. "VOCALOID2 Owner's Manual" August 2007. pp. 113-115 (hereinafter, Yamaha reference) disclose techniques in which real-time voice synthesis is carried out on lyrics to music played by a user, the lyrics having been input beforehand. In addition, the Yamaha reference discloses a display that shows a User Interface (UI) for adjusting voice synthesis parameters.

One use of voice synthesis devices is to create digital content that accompanies images such as games and Computer Graphics (CG) animations. In such content, a proper balance should be maintained between synthesized voices and accompanying images so as to avoid an undesirable impression of incongruity between the two being imparted to a user. JP 2008-165130, JP 2008-170592, and the Yamaha reference each disclose techniques for editing data that represents parameters used in voice synthesis; however, the devices disclosed in these references perform voice synthesis only. If, when creating the abovementioned content, the techniques disclosed in these related documents were to be applied, changes would be made to the parameters used in voice synthesis only; this is likely to lead to an Undesirable imbalance between duly synthesized voices and accompanying unchanged images.

SUMMARY OF THE INVENTION

In view of the above-stated matters, it is an object of the present invention to provide a technique that avoids any undesirable imbalance occurring between voices that are synthesized based on changed parameters, and accompanying images, in case the parameters used in the voice synthesis have been changed.

The present invention provides an information processing method including the following: receiving a change instruction to change a voice parameter used in synthesizing a voice for a set of texts; changing the voice parameter in accordance with the change instruction; changing, in accordance with the change instruction, an image parameter used in synthesizing an image of a virtual object, the virtual object indicating a character that vocalizes the voice that has been synthesized; synthesizing the voice using the changed voice parameter; and synthesizing the image using the changed image parameter. The present invention also is implemented as an information processing device including the following: a voice synthesizer configured to synthesize a voice for a set of texts using a voice parameter; an image synthesizer configured to synthesize an image of a virtual object using an image parameter, the virtual object indicating a character that vocalizes a voice that has been synthesized by the voice synthesizer; an instruction receiver configured to receive a change instruction to change the voice parameter; a voice parameter changer configured to change the voice parameter in accordance with the change instruction to change the voice parameter; and an image parameter changer configured to change the image parameter in accordance with the change instruction to change the voice parameter In such a voice processing method and voice processing device, upon receipt of an instruction to change a voice parameter, an image parameter is changed together with the voice parameter. In other words, a change in the image parameter is linked to a change in the voice synthesis parameter. Consequently, imbalance can be prevented from occurring between a voice and an image synthesized based on changed parameters, when a parameter for voice synthesis is changed.

BRIEF DESCRIPTION OF THE DRAWINGS

FIG. 6 is a flowchart showing an example operation of an image synthesis controller 250 according to the embodiment.

FIG 7 is a flowchart showing an example operation of a UI unit 210 according to the embodiment.

FIG. 8 is a diagram showing an example of correspondences between voice parameters and image parameters.

DESCRIPTION OF THE EMBODIMENTS

1. Configuration

Figure 1:
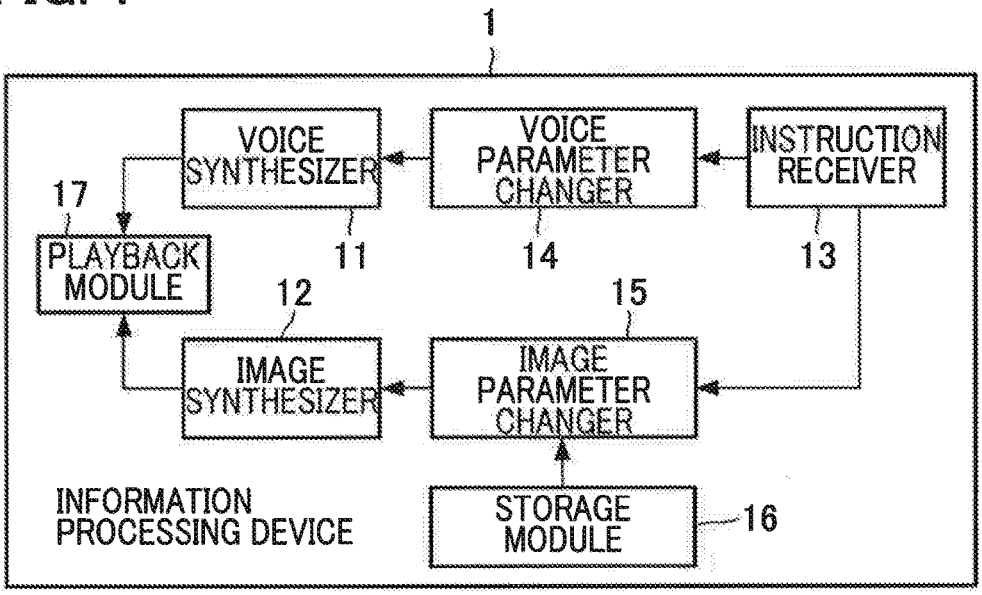
FIG. 1 is a diagram showing an example functional configuration of an information processing device 1 according to one embodiment.

FIG. 1 is a diagram showing an example functional configuration of an information processing device 1 according to one embodiment. The information processing device 1 performs voice synthesis and image synthesis. The term "voice synthesis" as used herein refers to a process of generating (synthesizing) a voice obtained by vocalizing a text (such as lyrics) to a melody, i.e., a singing voice. The voice generated by voice synthesis is referred to as a "synthetic voice". The information processing device 1 performs voice synthesis in real time. In other words, a user may change the parameters used in voice synthesis (hereinafter referred to as "voice parameters") while the synthetic voice is being played. Change in voice parameters are reflected in the synthetic voice being played. Furthermore, the information processing device 1 also performs a corresponding image synthesis. The term "image synthesis" as used herein refers to a process of generating (synthesizing) an image of a virtual object that moves in a particular manner in front of a particular background. The image generated by the image synthesis process is referred to hereinafter as a "synthetic image". The information processing device 1 plays a synthetic voice and a synthetic image after synchronizing them. When a user instructs the information processing device 1 to change voice parameters, the device 1 changes not only the voice parameters but also image synthesis parameters (hereinafter, "image parameters"). That is, when a user provides to the information processing device 1 an instruction to change the voice parameters, not only is the synthetic voice changed, but the synthetic image also is changed, correspondingly The information processing device 1 includes a voice synthesizer 11, an image synthesizer 12, an instruction receiver 13, a voice parameter changer 14, an image parameter changer 15, a storage module 16, and a playback module 17.

The voice synthesizer 11 generates a synthetic voice by synthesizing a given text set and a melody based on specified voice parameters. The voice parameters differentiate one synthetic voice from another. When values of the voice parameters differ, the resulting synthetic sounds also differ, even when the same text set and melody are used. The voice synthesizer 11 uses multiple voice parameters to perform voice synthesis. These voice parameters will be described later in more detail.

The image synthesizer 12 generates a synthetic image by synthesizing a background and a virtual object based on specified image parameters. These image parameters differentiate one synthetic image from another. When values of the image parameters differ, the resulting synthetic images also differ, even if the same background and virtual object are used. The image synthesizer 12 uses multiple image parameters to perform image synthesis. The image parameters will be described later in more detail.

Upon receipt at the instruction receiver 13 of an instruction from a user to change the voice parameters, the voice parameter changer 14 changes the voice parameters based on the received instruction. The expression "to change voice parameters" as used herein refers to changing voice parameter values. The image parameter changer 15 changes image parameters in response to the user instruction to change the voice parameters. The expression "to change image parameters" as used herein refers to changing image parameter values. In the present example, the storage module 16 stores correspondences between multiple voice parameters and multiple image parameters. The image parameter changer 15 may change among multiple image parameters one image parameter that corresponds to a voice parameter for which a change instruction has been received from the user at the instruction receiver 13.

The playback module 17 plays a synthetic voice and a synthetic image after synchronizing them. In the present example, the voice parameter changer 14 and the image parameter changer 15 respectively change voice parameters and image parameters in real time, while the playback module 17 plays the synthetic voice and the synthetic image.

Figure 2:
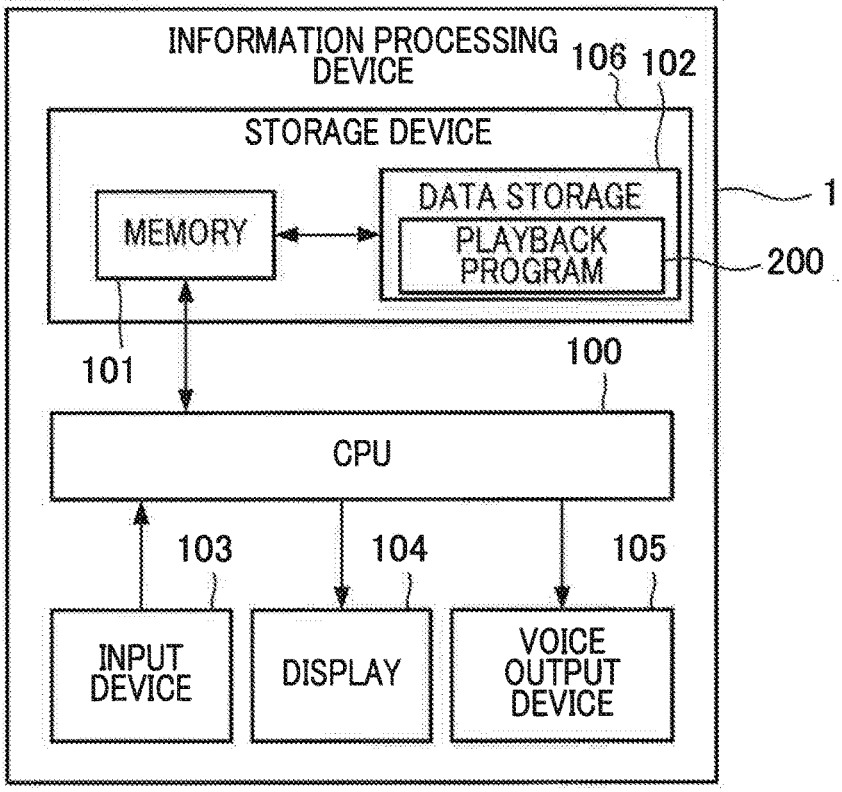
FIG. 2 is a diagram showing an example hardware configuration of the information processing device 1.

FIG. 2 is a diagram showing an example hardware configuration of the information processing device 1. The information processing device 1 is a computer device including a central processing unit (CPU) 100, a storage device 106 fitted with a memory 101 and a data storage 102, an input device 103, a display 104, and a sound output device 105. The CPU 100 performs various computations and controls other hardware elements. The memory 101 is a storage device configured to store codes and data used in processes performed by the CPU 100. Examples of the memory 101 include a Read-Only Memory (ROM) and a Random Access Memory (RAM). The data storage 102 is a non-volatile storage device configured to store various types of data and programs, and may be a hard disk drive (HDD) or a flash memory. The input device 103 is used for inputting information into the CPU 100, and includes at least one of a key board, a touch screen, a remote controller and a microphone. The display 104 is used to output images, and may be a liquid crystal display or an organic electroluminescence (EL) display, for example. The sound output device 105 is used to output voices. Examples of the voice output device 105 include a digital analog (DA) convertor, an amplifier, and speakers. By retrieving and executing the program stored in the data storage 102, the CPU 100 functions as the voice synthesizer 11, the image synthesizer 12, the voice parameter changer 14, and the image parameter changer 15. The CPU 100, the input device 103, and the display 104 function as the instruction receiver 13; while the CPU 100, the display 104, and the sound output device 105 function as the playback module 17.

The data storage 102 stores a program (hereinafter, "playback program 200") that causes a computer device to perform voice synthesis, image synthesis, and playback of the synthetic voice and the synthetic image. The CPU 100 executes the playback program 200 and operates in coordination with other hardware elements, thereby to implement the voice synthesizer 11, the image synthesizer 12, the voice parameter changer 14 and the image parameter changer 15 of the information processing device 1. The CPU 100 operates in coordination with the input device 103 and the display 104, so as to receive instructions from a user to change the voice parameters; namely, the CPU 100 functions as the instruction receiver 13 The CPU 100 also functions as the playback module 17, which plays the synthetic voice and the synthetic image after synchronizing them with each other, by causing the display 104 to display the synthetic image and the sound output device 105 to output the synthetic voice. All or a part of these functions may be implemented by exclusive electric circuitry. The storage device 106 (the memory 101 and the data storage 102) is one example of the storage module 16.

Figure 3:
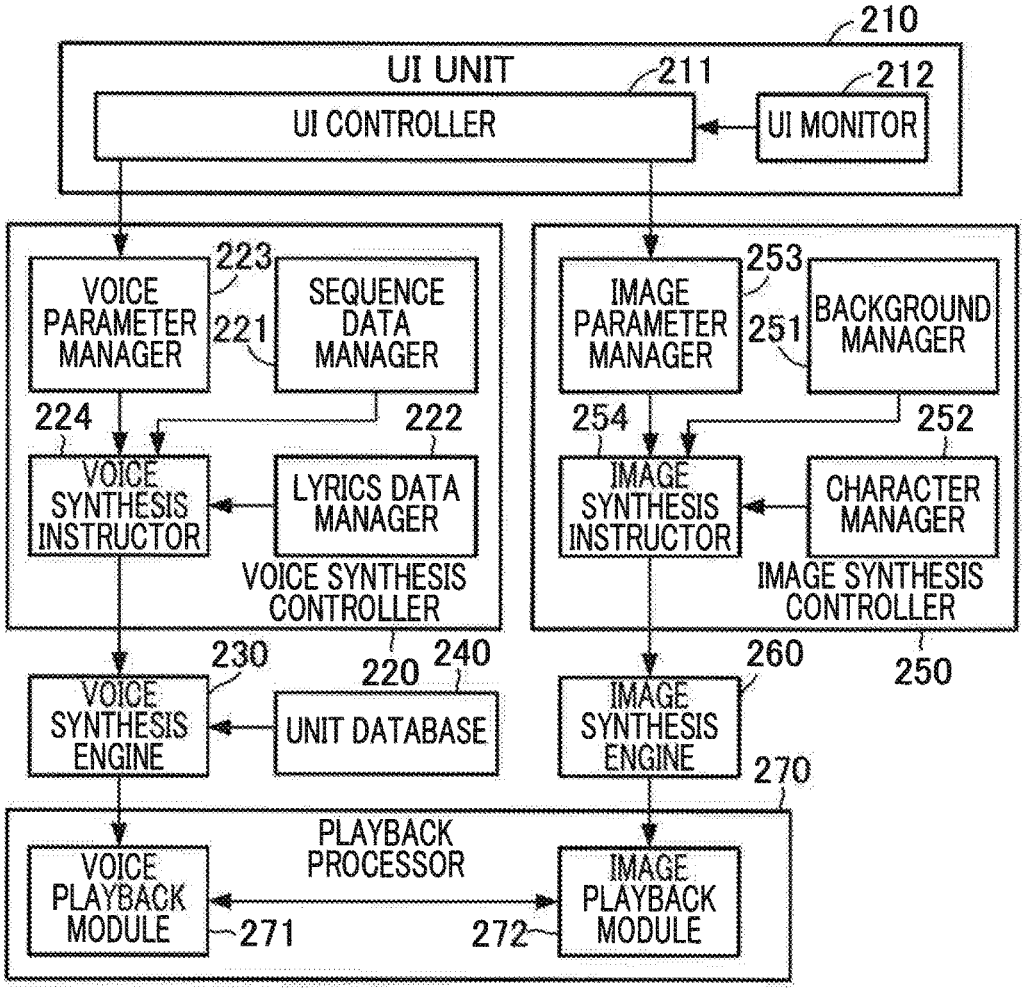
FIG. 3 is a diagram showing details of an example functional configuration of the information processing device 1.

FIG. 3 is a diagram showing details of an example functional configuration of the information processing device 1. As shown in the figure, in the information processing device 1, the CPU 100 executes and runs the playback program 200, thus functioning as each of a UI unit 210, a voice synthesis controller 220, a voice synthesis engine 230, an image synthesis controller 250, an image synthesis engine 260, and a playback processor 270. The voice synthesis controller 220 controls voice synthesis, and may include a sequence data manager 221, a lyrics data manager 222, a voice parameter manager 223, and a voice synthesis instructor 224. The sequence data manager 221 and the lyrics data manager 222 are functional elements realized by the storage device 106. The sequence data manager 221 manages (stores) the sequence data. The sequence data consists of performance information that indicates a melody, i.e., a sequence of notes. An example of such sequence data is MIDI (Musical Instrument Digital Interface) data. The lyrics data manager 222 manages (stores) the lyrics data that represents lyrics, i.e., a set of texts, and, for example, is text data.

Between the set of texts indicated by the lyrics data and the notes indicated by the sequence data, correspondences are established. The voice parameter manager 223 is a functional element that is realized by the CPU 100 and the storage device 106. The voice parameter manager 223 manages the voice parameters. Specifically, the voice parameter manager 223 stores voice parameters and changes the voice parameters in accordance with the instruction from the UI unit 210. The voice synthesis instructor 224 instructs the voice synthesis engine 230 to perform voice synthesis. The voice synthesis instructor 224 is a functional element realized by the CPU 100.

The unit database 240, in which voice units are stored, is formed in the storage device 106 (more specifically, the data storage 102). A voice unit is a section of waveform data based on which a synthetic voice is created. A voice unit is extracted from a voice waveform obtained by sampling a singing voice of a person, and one voice unit comprises one or more voiced units (phonemes), such as vowels and consonants. Voice units are classified based on their relationship both to preceding and subsequent phonemes. Example classifications include a rise, a transition from a consonant to a vowel, a transition from a vowel to another vowel, sustaining of a vowel, and a fall. In addition, because voice units are obtained by sampling actual human voices, voice units are classified with reference to a singer whose voice has been sampled.

The voice synthesis engine 230 performs voice synthesis by using each of the sequence data, the lyrics data, and the unit database 240. Specifically, the voice synthesis engine 230 breaks down texts indicated by the lyrics data into phonemes. Then, the voice synthesis engine 230 retrieves, from the unit database 240, a voice unit that corresponds to a particular phoneme. Subsequently, the voice synthesis engine 230 adjusts the retrieved voice unit to a pitch indicated by the sequence data. The voice synthesis engine 230 then processes the pitch-adjusted voice unit according to specified voice parameters.

The voice parameters include at least one of dynamics (DYN), gender factor (GEN), velocity (VEL), breathiness (BRE), brightness (BRI), clearness (CLE), portamento timing (POL), pitch bend (PIT), and pitch bend sensitivity (PBS) for example. The voice parameters preferably include two or more of the above parameters. The dynamics parameter is used to adjust a volume. In more detail, the dynamics parameter in voice synthesis does not simply change a volume (i.e., uniformly change an overall power regardless of frequency bands), but rather changes in a non-uniform manner a power for each frequency band, thereby enabling a change in timbre. A so-called gender factor parameter adjusts the formant structure ("masculinity" or "femininity") of a voice. The velocity parameter adjusts the intensity of a voice, or more specifically, a duration of a consonant. The breathiness parameter adjusts an intensity of a breath component in a voice. The brightness parameter adjusts the tone, i.e. the brightness, of a voice. The clearness parameter adjusts the clearness of a voice, or more specifically, an intensity of higher notes in a voice. The portamento timing parameter adjusts a naturalness of an interval transition in a voice, or more specifically, a timing at which an interval changes when one note moves to another note in a different interval. The pitch bend parameter indicates whether there is a change in the pitch of a voice. The pitch bend sensitivity parameter indicates a range of a pitch change.

The voice synthesis engine 230 connects the processed voice units and thereby generates a synthetic sound that corresponds to a given set of texts and melody. The voice synthesis engine 230 finally outputs the generated synthetic voice. The voice synthesis engine 230 is a functional element realized by the CPU 100.

The image synthesis controller 250 controls image synthesis. The image synthesis controller 250 includes a background manager 251, a character manager 252, an image parameter manager 253, and an image synthesis instructor 254. The background manager 251 and the character manager 252 are functional blocks realized by the storage device 106. The background manager 251 manages (stores) background data, which data represents the background as an image. In this example, the background is a virtual three-dimensional space; such a space may be a concert hall, a stadium, or a room in a home. The background data includes data that defines a size and shape of the virtual three-dimensional space, and data that defines virtual objects present within the virtual three-dimensional space (for example, spotlights and screens in a concert hall). The character manager 252 manages (stores) character data, and each piece of character data indicates a character that Is a virtual object present in the virtual three-dimensional space, and which vocalizes a synthetic voice. The character may be any form that is associated with movement, for example, a person, an animal, or a robot. The character data includes data that defines the appearance of the character, namely its expression, shape, color or decoration, for example, and also data that defines movements of the character (the motion or position for example). The image parameter manager 253 is a functional element that is realized by the CPU 100 and the storage device 106, and which manages image parameters. Specifically, the image parameter manager 253 stores the image parameters and changes the image parameters according to an instruction from the UI unit 210. The image synthesis instructor 254 is a functional element that is realized by the CPU 100, and which instructs the image synthesis engine 260 to perform image synthesis.

The image synthesis engine 260 synthesizes an image captured by a virtual camera and outputs the image data, the captured image being an image of a virtual object of a character represented by the character data that is arranged in the virtual three-dimensional space represented by the background data. The term "image data" as used herein generally refers to a synthetic image and, in this particular example, refers to a motion picture that changes at a predetermined frame rate of, for example, 30 fps or 60 fps.

A synthetic image changes depending on associated image parameters. Image parameters are classified into three kinds: those that change a character; those that change a background; and those that change camera work of a virtual camera. The parameters that change the character include at least one of the following: a parameter that changes a relative size of the character against a background; a parameter that changes a color and decoration of the character (for example, a change of clothes); a parameter that changes a proportion (ratio of total height to length of the head) of the character, for example, from a two-head-tall to an eight-head-tall character; and a parameter that changes a shape of the character, for example, from a male to a female shape. The image parameters that change the background include at least one of the following examples: a parameter that changes the type of virtual space, for example, from a concert hall to a stadium; and a parameter that changes a propel ty of a virtual object within the virtual space, for example a color of spotlights. The image parameters that change the virtual camera work include at least one of the following: a parameter that changes a position (point of view) of the virtual camera in the virtual space; a parameter that changes a direction (panning) of the virtual camera; and a parameter that changes an angle of view (zoom factor) of the virtual camera. It is of note that the image parameters include information that defines a timing (a point in time) at which to change such properties. In other words, an image parameter is a sequence of information that includes information that changes in value over time. It is preferable that at least one of the above-mentioned kinds of image parameters be included in the image parameters; and more preferable still that a plurality of the above-mentioned kinds of image parameters be included in the image parameters. The image synthesis engine 260 is a functional element realized by the CPU 100.

The UI unit 210 provides functions related to the UI. These functions are attained by the CPU 100 and each of the input device 103, the display 104, and the storage device 106 working in coordination with each other. The UI unit 210 includes a UI controller 211 and a UI monitor 212. The UI controller 211 controls the UI. More specifically, the UI controller 211 causes, for example, the display 104 to show a screen for receiving an instruction to change the voice parameters. The UI monitor 212 monitors the UI. More specifically, the UI monitor 212 monitors whether the user carries out a predetermined operation using the input device 103.

The UI monitor 212 requests the voice parameter manager 223 to change values of voice parameters in response to a change instruction to change voice parameters, the instruction being input via the input device 103. Responsive to the request, the voice parameter manager 223 appropriately changes the values of the voice parameters. Moreover, the UI monitor 212 requests the image parameter manager 233 to change the values of the image parameters responsive to the change instruction to change the voice parameters, the instruction being input by the user via the input device 103. Responsive to the request, the image parameter manager 233 appropriately changes values of the image parameters. In other words, the voice parameters and also the image parameters are able to be changed based on a single input operation carried out by the user via the input device 103. The UI unit 210 stores data on correspondences between the voice parameters and the image parameters; and based on the thus stored data on correspondences, the UI monitor 212 determines which image parameter to change in response to the instruction input by the user to change the voice parameter The playback processor 270 plays the synthetic voice and the synthetic image that have been synchronized with each other. The playback processor 270 includes a voice playback module 271 and an image playback module 272, and the functions of these units are realized by the CPU 100 operating in coordination with the display 104 or the sound output device 105. The voice playback module 271 plays the voice that has been synthesized by the voice synthesis engine 230. In the present example, the voice playback module 271 also plays an accompaniment along with the synthetic voice. Such accompaniment may be karaoke music where preexisting vocals have been removed from a song. In such a case, data for the vocal accompaniment is stored in the data storage 102 in advance. The voice playback module 271 plays back the synthetic voice and the accompaniment after synchronizing them with each other. The image playback module 272 plays the synthetic image. The voice playback module 271 and the image playback module 272 share, for example, a pointer that indicates a playback position and a clock signal that indicates a processing timing. By utilizing these elements, the voice playback module 271 and the image playback module 272 synchronize playback of a voice (synthetic voice and accompaniment) and playback of a synthetic image. For example, the playback processor 270 plays the synthetic image and the synthetic voice such that the synthetic image and the rhythm of the singing voice (and also the accompaniment) coincide, the synthetic image representing how the character moves its mouth while singing and how it moves its body while dancing.

Figure 4:
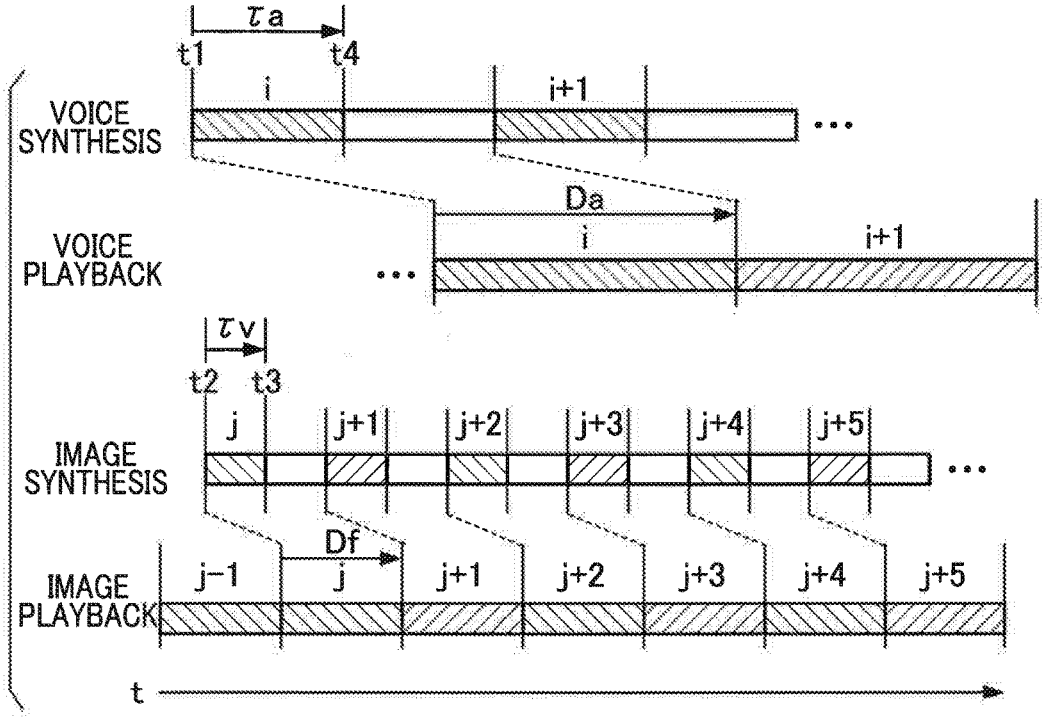
FIG. 4 is a diagram showing real-time voice synthesis and image synthesis.

FIG. 4 shows voice synthesis and image synthesis performed in real-time. In real-time voice synthesis, the synthesis and playback of a voice are processed in a parallel manner, and not in a manner in which a synthetic voice is played after voice synthesis has been completed for an entire music track. Real-time image synthesis is carried out in substantially the same manner.

In this example, sequence data and lyrics data each are divided into multiple sections. Out of the multiple sections, one section after another in a sequential order is specified as the target section. Voice synthesis is performed on each target section; and the target section may consist as a unit of a predetermined number of sequential bars. Alternatively, each section may include rests as breaks. In this case, the different sections have differing time lengths. In the description given below the i-th section will be referred to as section (i).

The figure shows voice synthesis being performed on sections (i) to (i+1). At time t1, the voice synthesis engine 230 commences voice synthesis on section (i). A time required for such voice synthesis to be completed on one section is $\tau a$. At time t4, the voice synthesis engine 230 outputs the synthetic voice of section (i). The time la required for voice synthesis is shorter than the time Da required for playback of a synthetic voice for one section. A margin of time is secured between a time at which synthetic voice is played.

At the same time as synthesis and playback of a voice are carried out, synthesis and playback of a corresponding image also are carried out. In the description given below the j-th section will be referred to as the frame (j). The figure shows image synthesis being performed on sections (j) to (j+5). In this example, the time lengths and the starting time of one section (one unit of voice synthesis) and those of one frame (one unit of image synthesis) are different. The time lengths of a section and a frame are determined based on the processing capacity of a processor for example. Thus, in one example, a section is 0.5 to 1 second, and a frame is 16.7 milliseconds, which is equivalent to 60 fps. For the sake of simplicity, FIG. 4 shows an example in which a time length of a section is only several times the length of a frame.

At time t2, the image synthesis engine 260 commences image synthesis on frame (j). A time required for image synthesis to be completed on one frame is $\tau v$. At time t3, the image synthesis engine 260 outputs the synthetic image of frame (i). The time $\tau v$ required to complete image synthesis is shorter than the time Df for one frame. Again, a margin of time is secured between a time at which the synthesis of the image is completed and a time at which playback of the image starts.

With regard to the relationship between FIG. 1 and FIG. 3, the voice synthesis engine 230 provides one example of the voice synthesizer 11. The image synthesis engine 260 is one example of the image synthesizer 12. The UI unit 210 is one example of the instruction receiver 13. The voice parameter manager 223 is one example of the voice parameter changer 14. The image parameter manager 233 is one example of the image parameter changer 15. The playback processor 270 is one example of the playback module 17.

2. Operation

In the following, operation of the information processing device 1 will be described. The UI unit 210, the voice synthesis controller 220, and the image synthesis controller 250 operate in parallel with each other. First, operation of these elements will be described individually, and then an example of processing in its entirety carried out by the information processing device 1 will be described.

2-1. Voice Synthesis Controller 220

Figure 5:
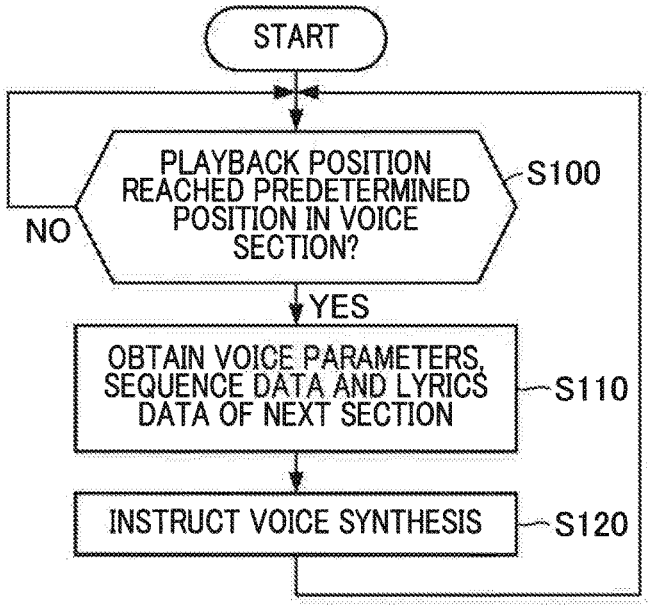
FIG. 5 is a flowchart showing an example operation of a voice synthesis controller 220 according to the embodiment.

FIG. 5 is a flowchart showing an example operation of the voice synthesis controller 220; in particular, the voice synthesis instructor 224 according to the present embodiment. Start of the flow sequence shown in FIG. 5 is triggered by execution of the playback program 200 whereupon playback of a synthetic voice and a synthetic image commences.

At step S100, the voice synthesis instructor 224 determines whether the playback position or playback time of the voice has reached a predetermined position within a section. The playback position of a voice is managed by the voice playback module 271, and is indicated by a "pointer", which functions as a parameter for a playback position. As time elapses, the playback position advances. Specifically, a value of the pointer is subject to an incremental increase in space concurrent with each elapse in time indicated, for example, by a clock signal. The voice synthesis instructor 224 obtains the playback position of a voice by referring to the incremented values of the pointer. The "predetermined position" is a position equivalent to a start ume at which a voice synthesis operation commences on a subsequent section, the position being calculated based on time period obtained by subtracting from a time at which playback of the subsequent section is expected to start a sum of the time required to complete the present voice synthesis operation and a time margin that follows completion of the voice synthesis operation and continues until playback of the synthesized voice starts. The voice synthesis instructor 224 proceeds to step S110 once it is determined that the playback position has reached the predetermined position (S100: YES). The voice synthesis instructor 224 waits for the playback position to reach the predetermined position, and in the meantime determines that the playback position has not yet reached the predetermined position (S100: NO).

At step S110, the voice synthesis instructor 224 obtains current voice parameters from the voice parameter manager 223, and obtains respectively from the sequence data manager 221 and the lyrics data manager 222, sequence data and lyrics data for the subsequent section.

At step S120, the voice synthesis instructor 224 instructs the voice synthesis engine 230 to perform voice synthesis based on the obtained voice parameters, sequence data, and lyrics data. The voice synthesis instructor 224 repeats the processing of steps S100 to S120 until an instruction is received to stop playback.

2-2. Image Synthesis Controller 250

FIG. 6 is a flowchart showing an example operation of the image synthesis controller 250; in particular, the image synthesis instructor 254 according to the present embodiment. Start of the flow sequence shown in FIG. 6 is triggered by execution of the playback program 200 whereupon playback of a synthetic voice and image commences.

At step S200, the image synthesis instructor 254 determines whether the playback position or playback time of the image has reached a predetermined position Within a frame. The playback position of an image is managed by the image playback module 272, and the playback position of the image is indicated by the pointer that is used in common by the voice playback module 271. The playback position advances as time elapses as described above in relation to the voice playback module 271 The image synthesis instructor 254 obtains a playback position of an image by referring to a value of the pointer. Here, the "predetermined position" is a position equivalent to a start time at which an image synthesis operation commences on the subsequent section, the position being calculated based on a time period obtained by subtracting from a time at which playback of the subsequent section is expected to start a sum of the time required to complete the present image synthesis operation and a time margin that follows completion of the voice synthesis operation and continues until playback of the synthesized image starts. The image synthesis instructor 254 moves the processing operation to step S210 once it has been determined that the playback position has reached the predetermined position (S200: YES). The image synthesis instructor 254 waits for the playback position to reach the predetermined position, when it is determined that the playback position has not yet reached the predetermined position (S200: NO).

At step S210, the image synthesis instructor 254 obtains the current image parameters from the image parameter manager 253, and also obtains from the background manager 251 and the character manager 252 the background data and the character data of the subsequent frame.

At step S220, the image synthesis instructor 254 instructs the image synthesis engine 260 to performimage synthesis using the obtained image parameters, background data, and character data. The voice synthesis instructor 254 repeats the processing of steps S200 to S220 until an instruction is received to stop the playback.

2-3. UI Unit 210

FIG. 7 is a flowchart showing an example operation of the UI unit 210 according to the embodiment. Start of the operation flow shown in FIG. 7 is triggered when the playback program 200 is executed to begin playing a synthetic voice and a synthetic image.

At step S300, the UI unit 210 determines whether an instruction to change a voice parameter has been received. Such an instruction is received via the UI screen on the display 104. The instruction to change a voice parameter includes information that indicates the identifier of a voice parameter that is to be changed, and an amount of change to be made. The UI unit 210 moves the processing to step S310 upon receipt of an instruction to change a voice parameter (3300: YES). The UI unit 210 awaits receipt of the instruction to change the voice parameter, when it is determined that the instruction to change the voice parameter has not yet been received (S300: NO).

At step S310, the UI unit 210 instructs the voice synthesis controller 220 to change the voice parameter according to the received instruction to change the voice parameter. The voice parameter manager 223 changes a voice parameter according to the instruction from the UI unit 210.

At step S320, the UI unit 210 instructs the image synthesis controller 250 to change the image parameter according to the received instruction to change the image parameter. As mentioned above, the UI unit 210 stores correspondences between voice parameters and image parameters.

FIG. 8 is a diagram showing an example of correspondences between voice parameters and image parameters. In this example, the correspondences are recorded in a table. The table includes items of voice parameters, image parameters and coefficients. In the column of voice parameters, the identifiers of the voice parameters to be changed are stored. In the column of image parameters, the identifiers of the image parameters corresponding to the voice parameters to be changed are stored. In the column of coefficients, coefficients that each indicate a quantitative relationship between a change in the corresponding voice parameter and a change in the corresponding image parameter are stored. In the example of FIG. 8, it is indicated that the voice parameter of dynamics (DYN) relates to the image parameter of size. The quantitative relationship between the two is 1:1. In the same example, it is indicated that the voice parameter of gender factor (GEN) relates to the image parameter of proportion. The quantitative relationship between the two is 1:0.5

In response to the received instruction to change a voice parameter, the UI unit 210 identifies an image parameter that corresponds to the voice parameter to be changed and an amount of change to be made, referring to the table of FIG. 8. For example, when an instruction to change a value of the voice parameter of DYN by −30, the UI unit 210 generates an instruction to change the image parameter of size by −30. The UI unit 210 outputs to the image synthesis controller 250 the generated instruction. The image parameter manager 253 changes an image parameter according the instruction from the UI unit 210. Thus, based on a single input operation carried out by the user via the input device 103, both a voice parameter and an image parameter can be changed. The flow sequences shown in FIGS. 5 to 7 are executed in parallel. Therefore, changes can be made to a voice parameter and an image parameter concurrently with playback of a synthetic voice and image. Moreover, voice synthesis and image synthesis can be performed with such changes reflected thereupon.

2-4. Example of Overall Processing

Figure 9:
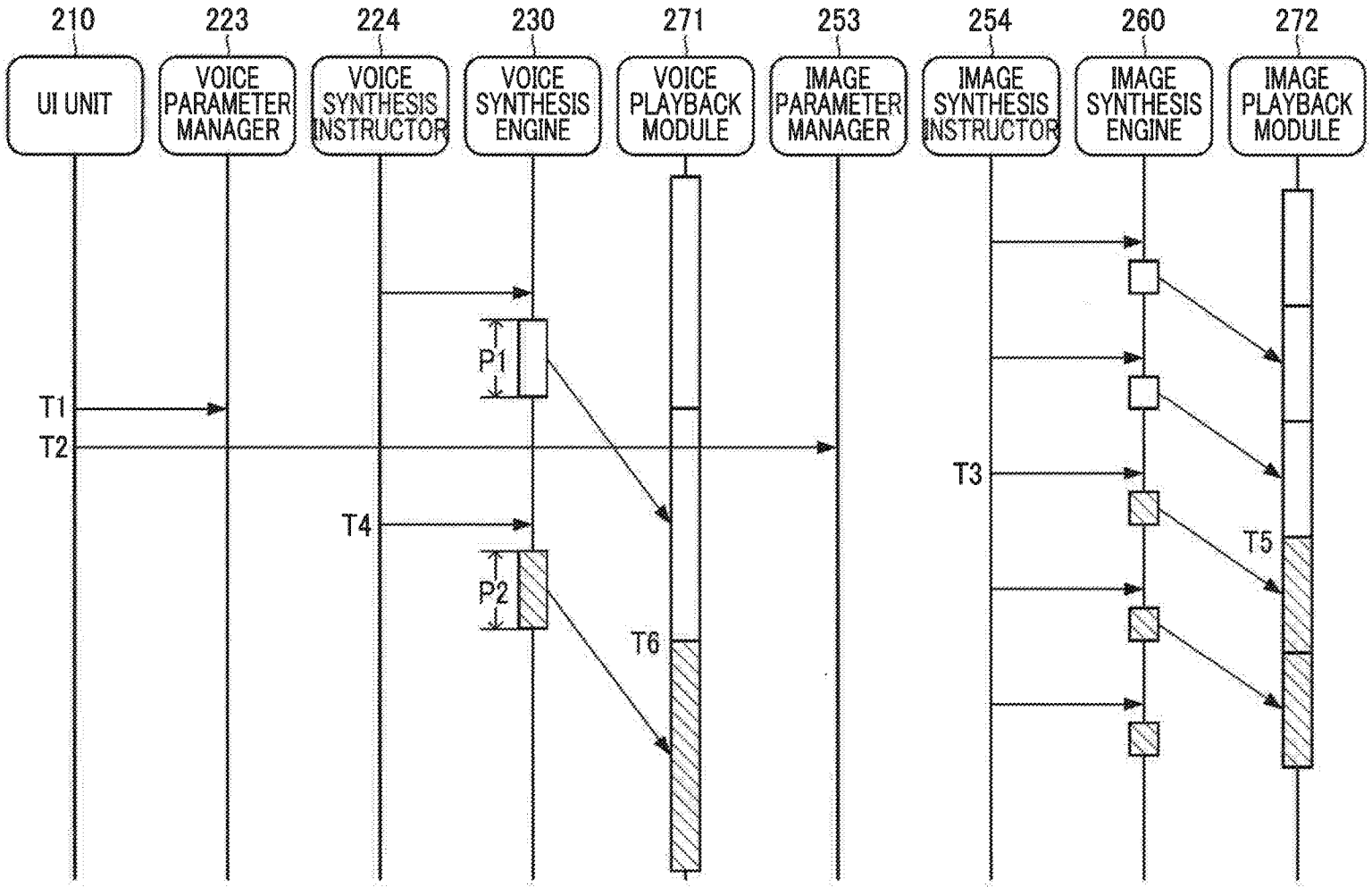
FIG. 9 is a sequence chart showing an example of an overall processing of the information processing device 1.

FIG. 9 is a sequence chart showing an example of an overall processing of the information processing device 1. At time T1, the UI unit 210 receives the instruction to change a voice parameter. At time T1, the UI unit 210 instructs the voice parameter manager 223 to change a voice parameter. The voice parameter manager 223 changes the voice parameter in accordance with such an instruction. At time T2, the UI unit 210 instructs the image parameter manager 253 to change an image parameter. The image parameter manager 253 changes the image parameter according to such an instruction. The instruction made at time T1 to change the voice parameter, and the instruction made at time T2 to change the image parameter are based on a single input operation carried out by the user that was received at time T1.

The image synthesis instructor 254 outputs an image synthesis instruction to the image synthesis engine 260 at a predetermined timing. At time T3, a first image synthesis instruction after a change has been made in the image parameter is output to the image synthesis engine 260. The instruction to change the image parameter issued at time T2 is reflected in the above image synthesis instruction. Thereafter, the image synthesis engine 260 performs image synthesis using the new image parameter. At time T5 and onward, the image playback module 272 plays an image that has been synthesized using the new image parameter (the hatched part of the figure).

The voice synthesis instructor 224 outputs a voice synthesis instruction to the voice synthesis engine 230 at a predetermined timing. At time T4, a first voice synthesis instruction after the change has been made to the voice parameter is output to the voice synthesis engine 230. The instruction to change the voice parameter output at time T1 is reflected in the above voice synthesis instruction. Thereafter, the voice synthesis engine 230 performs voice synthesis using the new voice parameter. At time T6 and onward, a voice that has been synthesized using the new voice parameter is played (the hatched section of the figure). Here, T1<T2<T3<T4<T5<T6. In other words, the voice synthesis engine 230 performs voice synthesis for a section P2 (an example of a second section) among multiple sections, using a voice parameter that has been changed according to an instruction to change the voice parameter that was received in the time between the start of voice synthesis performed for a section P1 (an example of a first section) and the start of voice synthesis performed for the section P2.

In this example, a time at which the image synthesized using the new image parameter starts to play and a time at which the voice synthesized using the new voice parameter starts to play need not necessarily correspond, since the section length of the sequence data and the lyrics data, in relation to both the voice, and the frame length of the image data differ. In particular, in a situation wherein a frame length of an image is shorter than a section length of voice synthesis (for example, where the frame length is a tenth to a hundredth of the section length), it is more likely for the playback of an image that has been synthesized using a new image parameter to start earlier than the playback of a voice that has been synthesized using a new voice parameter.

2-5. Example of Screen Display

Figure 10:
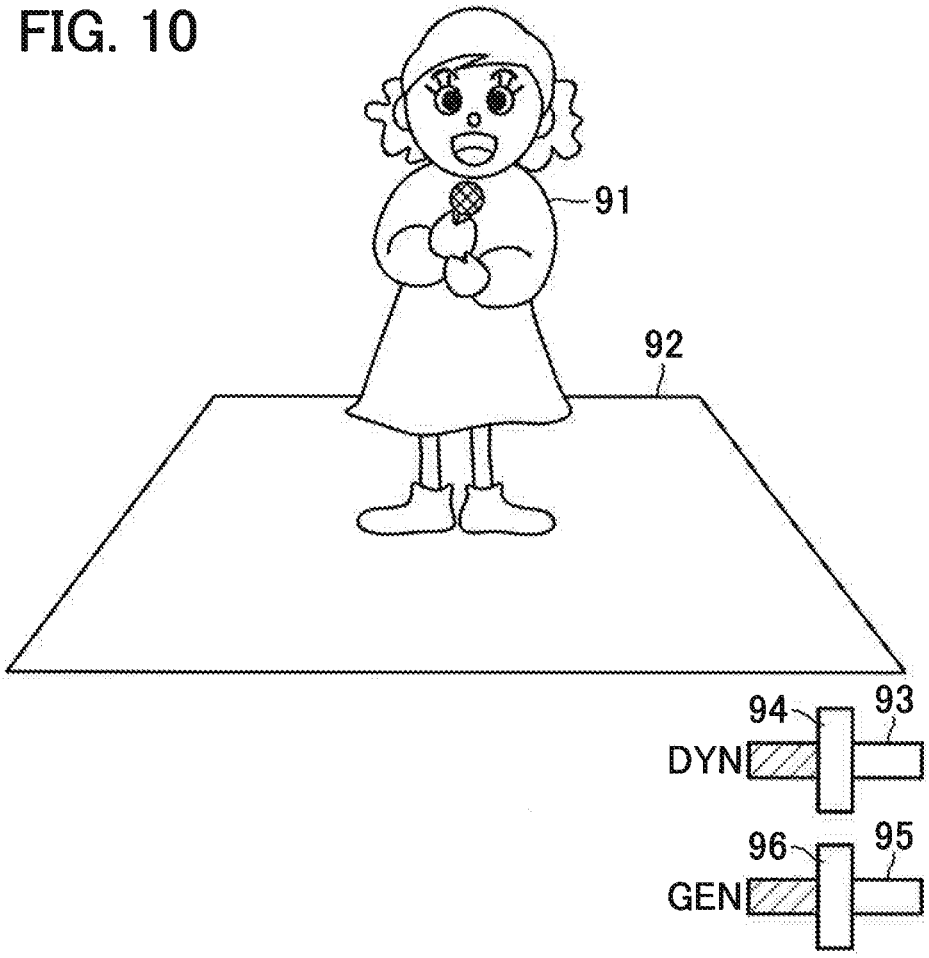
FIG. 10 is a diagram showing an example display upon execution of a playback program 200.

FIG. 10 is a diagram showing an example display upon the execution of the playback program 200. The figure shows a screen being displayed while a synthetic voice and a synthetic image are being played. The screen includes a character 91, a background 92, a gage 93, a slide bar 94, a gage 95, and a slide bar 96. The character 91 is an image object, which emits a synthetic voice. In this example, the character 91 is a female person. The background 92 indicates an image object of the virtual space in which the character 91 is positioned. In this example, the background 92 is a concert hall stage. The images of the character 91 and the background 92 move in synchronization with the playback of a sound (for example, the character 91 dances, or the lighting on the stage changes). The gage 93 is an image object that indicates a current value of the voice parameter DYN (dynamics). The slide bar 94 is an image object that indicates an operation unit used to change the value of the voice parameter DYN. The gage 95 is an image object that indicates a current value of the voice parameter GEN (gender factor). The slide bar 96 is an image object that indicates an operation unit used to change a value of the voice parameter GEN.

In this example, the information processing device 1 includes a touch screen functioning as the input device 103. The user can either increase or decrease the values of the voice parameter DYN and the voice parameter GEN by touching and moving the, positions of the slide bars 94 and 96 to the left or to the right on the screen.

Figure 11:
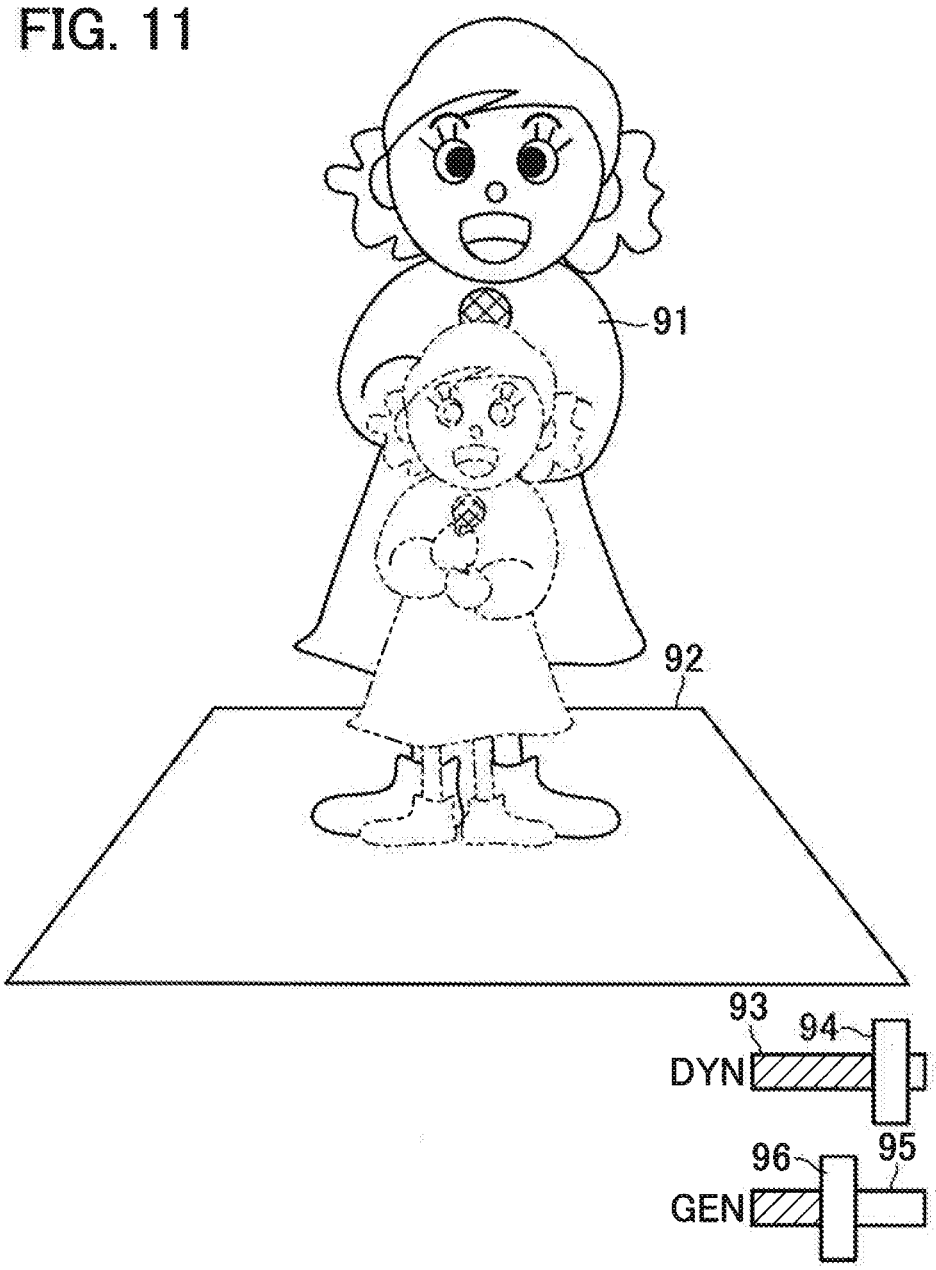
FIG. 11 is a diagram showing an example display upon execution of the playback program 200.

FIG. 11 is a diagram showing an example display upon the execution of the playback program 200. This figure shows an example in which an input operation is carried out to increase a value of the voice parameter DYN to a value higher than that in FIG. 10. The dynamics of the synthetic voice increase in an amount corresponding to this input operation. Furthermore, the relative size of the character 91 against the background 92 is increased based on this input operation. For reference, the size of the character 91 in FIG. 10 is indicated by a dotted line, although in reality the dotted line will not be displayed. According to this example, the relative size of the character 91 increases in approximate correspondence to the increase in volume of the synthetic voice.

Figure 12:
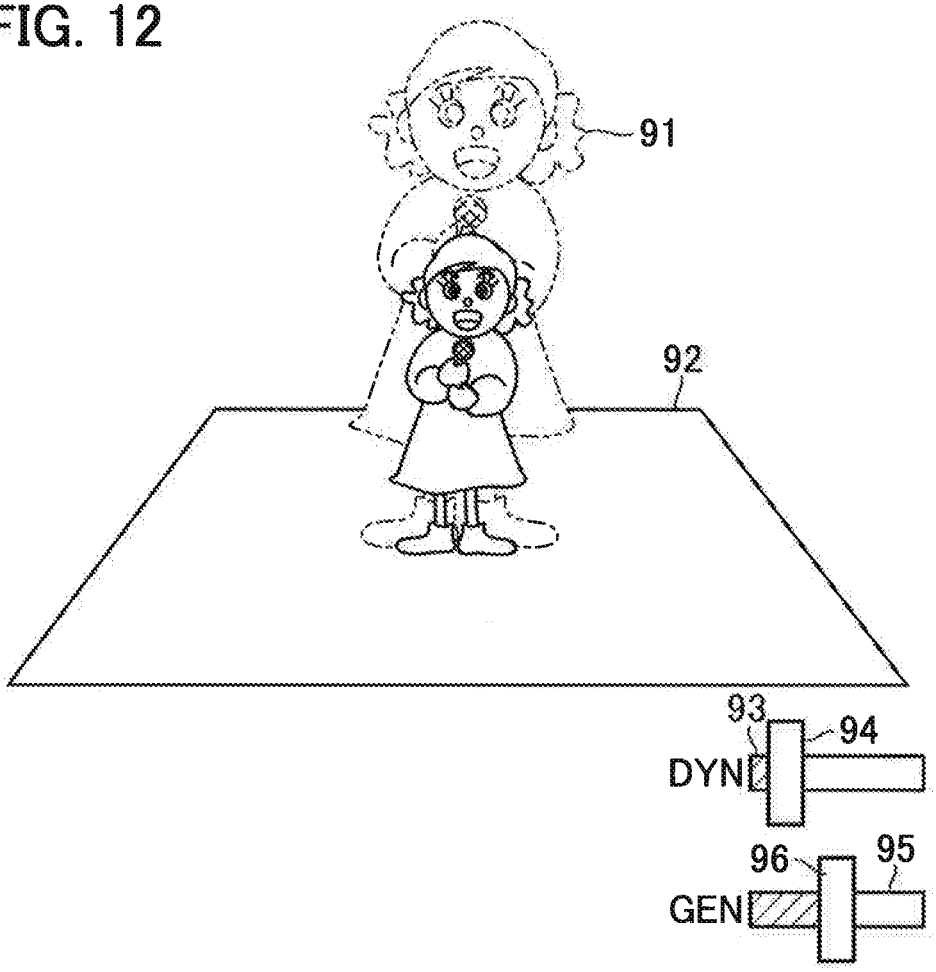
FIG. 12 is a diagram showing an example display upon execution of the playback program 200.

FIG. 12 is a diagram showing an example display upon execution of the playback program 200. This figure shows an example in which an input operation is carried out to decrease a value of the voice parameter DYN from the value in FIG. 10. The dynamics of the synthetic voice decrease by an amount that corresponds to this input operation. Furthermore, the relative size of the character 91 against the background 92 is decreased based on this input operation. For reference, the size of the character 91 in FIG. 10 is indicated by a dotted line. According to this example, the relative size of the character 91 is reduced in approximate correspondence to the decrease in volume of the synthetic voice. According to the present embodiment described above, the user can obtain a synthetic image for which an image parameter changes according to a change in a voice parameter.

As is also described above, the information processing method of the present embodiment enables an image to change in coordination with a change in a parameter in voice synthesis since, in response to a change image parameter is changed (for example, T2) alongside the relevant voice parameter. Consequently, an imbalance can be avoided between a voice and an image synthesized based on changed parameters, when a parameter in voice synthesis is changed.

In one embodiment of the present embodiment, the information processing method enables a synthetic voice and a synthetic image to be synchronized with each other and played, and while the synchronized synthetic voice and image are being played; voice parameters and image parameters can be changed. By this embodiment, it is possible to change a voice parameter and an image parameter in real-time, during the playback of a voice and an image. Accordingly playback of a variable voice and image becomes possible.

According to still another embodiment, synthesizing of a voice includes synthesizing a voice using a set of texts in a section that has been sequentially specified as a target section among multiple sections obtained by segmenting the set of texts, and synthesizing a voice for a second section (for example, P2) by using the voice parameter that has been changed according to a change instruction (for example, T4), received between the start of voice synthesis for a first section (for example, P1) and the start of voice synthesis for the second section. As a result, a change in the voice parameter is reflected in the voice to be played back with a minimal delay, and thus playback of a variable voice becomes possible.

According to still yet another embodiment, in the information processing method, receipt of a change instruction includes receiving a designation of any one of the multiple voice parameters; and a change in an image parameter includes changing at least one of the multiple image parameters, which parameter has been specified in correspondences (for example, those shown in FIG. 8) between the multiple voice parameters and the multiple image parameters, the correspondences having been stored in a storage device (the UI unit 210). In this embodiment, an image parameter that is stored in the storage device in correspondence with a voice parameter to be changed is changed. Accordingly, when an image parameter that suits the characteristics of a voice parameter is stored in the storage device in correspondence with the voice parameter, playback of a variable voice becomes possible while avoiding an imbalance between the synthetic voice and the synthetic image, the imbalance resulting from a change in parameters relative to the synthetic voice.

According to still yet another embodiment, the multiple voice parameters include a parameter for indicating dynamics of the voice (DYN), and the multiple image parameters include a parameter for indicating a size of the character 91. The storage device (the UI unit 210) stores the parameter indicating the dynamics of the voice and the parameter indicating the size of the character in correspondence with each other. The change in parameters may include changing an image parameter, chosen from among the multiple image parameters so as to change appropriately a size of the character 91 in accordance with an instruction to change the voice dynamics. Since a dynamic parameter is a voice parameter used for adjusting a volume of a voice, when the volume changes in accordance with a change in the voice parameter, the size of the character 91 also changes in correspondence with the change in the volume. Accordingly, it is possible to maintain a balance between the volume of the synthetic voice and the size of a synthetic image, which in this case is the character 91.

3. Modifications

The present invention is not limited to the above embodiment and various modifications are possible. A number of modifications will be described below. Two or more of the modifications described below may be combined as desired.

3-1. Modification 1

Processing may be carried out to enhance synchronicity between a timing at which playback of the synthetic sound reflecting the voice parameter change starts, and the timing at which playback of the synthetic image reflecting the image parameter change starts. Synchronicity between the two depends on a difference between a frame length of an image and a section length of a synthetic voice. Accordingly, the UI unit 210 may delay a timing at which to output to the image parameter manager 253 an instruction to change an image parameter by an amount of time corresponding to the difference between the frame length of an image and the section length of a synthetic sound.

3-2. Modification 2

A screen may display two or more characters. In such a case, each character is associated with a different synthetic voice. For voice synthesis of each character, respective voice parameters are independently controlled. For example, when two characters are displayed on a screen, the example screens as shown in FIGS. 10 to 12 will show two sets of the gages 93, the slide bars 94, the gages 95, and the slide bars 96. The two characters may be, for example, a pair consisting of a main vocalist and a backup singer, or a pair consisting of a first vocalist and a second vocalist. The user can change a voice parameter of each character individually. An image parameter for each character is individually changed according to a change in a voice parameter.

3-3. Modification 3

The present invention is not limited to voice synthesis and image synthesis performed in real-time (i.e., in parallel with playback of a voice). For example, a user can edit, prior to voice synthesis and image synthesis being performed, the changes in a voice parameter against time. In such a case, the HI unit 210 makes changes to an image parameter against time in correspondence with the changes made to the voice parameter against time. The voice synthesis controller 220 performs voice synthesis using the changes made to the voice parameter against time. The image synthesis controller 250 performs image synthesis using the changes made to the image parameter against time.

3-4. Modification 4

The present invention is not limited to voice parameters, image parameters or to a correspondence between the two. In actuality, two or more image parameters may be associated with a single voice parameter. For example, a parameter indicating a relative size of a character and a zoom factor of a virtual camera may be associated with the voice parameter DYN. In such a case, when dynamics are increased, both the relative size of the character and the zoom factor of the virtual camera increase.

3-5. Modification 5

The configuration of the information processing device 1 is not limited to a single physical device. A combination of multiple devices may possess the above-mentioned functions of the information processing device 1. For example, a server-client system connected via a network may possess the function of the information processing device 1. In one example, a server device may possess the functions of the voice synthesis engine 230, the unit database 240, and the image synthesis engine 260, and a client device may possess the remaining functions.

3-6. Modification 6

In the embodiment, an example is given in which an image parameter is changed corresponding to an instruction to change a voice parameter, without any instruction being given to change the image parameter itself. Conversely, the information processing device 1 may change a voice parameter in response to an instruction to change an image parameter, without any instruction being given to change the voice parameter itself. In this case, the example screens in FIGS. 10 to 12 will display image objects for changing the image parameter instead of image objects for changing the voice parameter (the gage 93, the slide bar 94, the gage 95, and the slide bar 96).

3-7. Modification 7

The present invention is not limited to voice synthesis for synthesizing a singing voice. A voice may be synthesized from texts, without the accompaniment of a melody.

3-8. Other Modifications

The hardware configuration of the information processing device 1 is not limited to the example described in the embodiment. The information processing device 1 may be of any hardware configuration as long as the required functions can be implemented. The information processing device 1 may be, for example, a desk top PC, a notebook PC, a smartphone, a tablet, or a game machine.

The functional configuration of the information processing device 1 is not limited to the example described in the embodiment. The functions of FIG. 3 may be partially implemented by a program that is different from the playback program 200. For example, the voice synthesis engine 230 and the image synthesis engine 260 may be implemented by a program that is different from the playback program 200. Furthermore, the detailed functional configuration for implementing the functional configuration exemplified in FIG. 1 is not limited to the example shown in FIG. 3. For example, the information processing device 1 need not necessarily include the playback processor 270. In this case, the synthetic voice generated by the voice synthesis engine 230 and the synthetic image generated by the image synthesis engine 260 may be output to a storage medium, or may be output to some other kind of device.

The program executed by the CPU 100 in the information processing device 1 may be provided in a non-transitory storage medium such as an optical disc, a magnetic, disc, or a semiconductor memory. Alternatively, the program may be downloaded via electronic communication media such as the Internet. It is of note that the non-transitory storage medium here includes all storage media from which data can be retrieved by a computer, except for a transitory, propagating signal; although volatile storage media are not excluded.

DESCRIPTION OF REFERENCE SIGNS

1 . . . information processing device, 11 . . . voice synthesizer, 12 . . . image synthesizer, 13 . . . instruction receiver, 14 . . . voice parameter changer, 15 . . . image parameter changer, 16 . . . storage module, 100 . . . CPU, 101 . . . memory, 102 . . . data storage, 103 . . . input device, 104 . . . display, 105 . . . voice output device, 106 . . . storage device, 200 . . . playback program, 210 . . . UI unit, 211 . . . UI monitor, 212 . . . UI controller, 220 . . . voice synthesis controller, 221 . . . sequence data manager, 222 . . . lyrics data manager, 223 . . . voice parameter manager, 224 . . . voice synthesis instructor, 230 . . . voice synthesis engine, 240 . . . unit database, 250 . . . image synthesis controller, 251 . . . background manager, 252 . . . character manager, 253 . . . image parameter manager, 254 . . . image synthesis instructor, 260 . . . image synthesis engine, 270 . . . playback processor, 271 . . . voice playback module, 272 . . . image playback module

What is claimed is:

1. A computer-implemented information processing method executed in a computer with a storage device, comprising executing on a processor the steps of:

dynamically displaying on a screen in the computer a moving image of a virtual object representing a character that vocalizes a synthesized singing voice;

providing an input receiver through which a first change instruction for changing a value of a voice parameter is inputted by a user, the voice parameter being one of a plurality of voice parameters used in synthesizing a singing voice from a set of texts;

in response to receiving the first change instruction, inputted by the user, to increase or decrease the current value of the voice parameter, changing the value of the voice parameter stored in the storage device in accordance with the first change instruction;

identifying, in accordance with the first change instruction to increase or decrease the current value of the voice parameter, an image parameter that corresponds to the voice parameter to be changed, from among a plurality of images parameters used in synthesizing the moving image of the virtual object;

creating a second change instruction to increase or decrease a value of the identified image parameter in accordance with the first change instruction to increase or decrease the value of the voice parameter;

changing the value of the image parameter stored in the storage device in accordance with the second change instruction;

playing a singing voice synthesized using the plurality of voice parameters including the changed voice parameter stored in the storage device; and displaying on the screen a moving image synthesized using the plurality of image parameters including the changed image parameter stored in the storage device, in such a way in which the moving image is changed in correspondence with the change in the singing voice.

2. The information processing method according to claim 1 further comprising the step of: synchronizing a synthetic voice and a synthetic image with each other and playing the synchronized synthetic voice and synthetic image, wherein the changing of the voice parameter and the changing of the image parameter includes changing the voice parameter and the image parameter while the synthetic voice and the synthetic image are being played.

3. The information processing method according to claim 2, wherein the synthesizing of the signing voice includes: synthesizing the voice using the set of texts in a section that has been sequentially specified as a target section among multiple sections obtained by segmenting the set of texts; and synthesizing the voice for a second section using the voice parameter that has been changed in accordance with the first change instruction, received between a start of voice synthesis for a first section and a start of voice synthesis for the second section.

4. The information processing method according to claim 1, wherein the voice parameter is one out of multiple voice parameters used for the voice synthesis, the image parameter is one out of multiple image parameters used for the image synthesis, the receiving of the first change instruction includes receiving a designation of any one out of the multiple voice parameters, and the changing of the image parameter includes changing at least one image parameter, out of the multiple image parameters, that has been specified in correspondences between the multiple voice parameters and the multiple image parameters, the correspondences having been stored in the storage device.

5. The information processing method according to claim 4, wherein the multiple voice parameters include a parameter for indicating dynamics of the voice, the multiple image parameters include a parameter for indicating a size of the character, the storage device stores the parameter indicating the dynamics of the voice and the parameter indicating the size of the character in correspondence with each other, and changing the image parameter indicating the size of the character, out of the multiple image parameters, when the first change instruction is an instruction to change the dynamics.

6. An information processing device comprising:

memory; and at least one processor configured to execute stored instructions to:

dynamically display on a screen a moving image of a virtual object representing a character that vocalizes a synthesized singing voice;

receive a first change instruction for changing a value of a voice parameter that is inputted by a user, the voice parameter being one of a plurality of voice parameters used in synthesizing a singing voice from a set of texts;

in response to receiving the first change instruction, inputted by the user, to increase or decrease the current value of the voice parameter;

change the value of the voice parameter stored in the memory in accordance with the first change instruction, identify, in accordance with the first change instruction to increase or decrease the current value of the voice parameter, an image parameter that corresponds to the voice parameter to be changed, from among a plurality of images parameters used in synthesizing the moving image of the virtual object;

create a second change instruction to increase or decrease a value of the identified image parameter in accordance with the first change instruction to increase or decrease the value of the voice parameter;

change the value of the image parameter stored in the memory in accordance with the second change instruction;

play a singing voice synthesized using the plurality of voice parameters including the changed voice parameter stored in the memory; and display on the screen a moving image synthesized using the plurality of image parameters including the changed image parameter stored in the storage device, in such a way in which the moving image is changed in correspondence with the change in the singing voice.

* * * * *